United States Patent [19]

Zonneveld et al.

[11] Patent Number: 4,969,345

[45] Date of Patent: Nov. 13, 1990

[54] METHOD AND APPARATUS FOR FORMING A COLLAR AROUND A HOLE IN A SHEET METAL BLANK

[75] Inventors: Louis M. Zonneveld, Uitgeest; Friedrich W. Thoolen, Beverwijk, both of Netherlands

[73] Assignee: Hoogovens Groep B.V., IJmuiden, Netherlands

[21] Appl. No.: 306,161

[22] Filed: Feb. 6, 1989

[30] Foreign Application Priority Data

Feb. 15, 1988 [NL] Netherlands ..... 8800361

[51] Int. Cl.[5] ..... B21D 22/00

[52] U.S. Cl. ..... 72/84; 72/102

[58] Field of Search ..... 72/69, 71, 77, 78, 81, 72/84, 102, 115, 122, 123, 126, 379, 125, 67, 73, 74, 80, 94, 112, 118

[56] References Cited

U.S. PATENT DOCUMENTS

| | | | |
|---|---|---|---|
| 173,808 | 2/1876 | Nugent | 72/122 |
| 304,671 | 9/1884 | Shepard | 72/122 |
| 422,615 | 3/1890 | Nugent et al. | 72/122 |
| 977,740 | 12/1910 | Higgins | 29/157 T |
| 1,670,216 | 5/1928 | Savadow | 72/112 |
| 1,830,865 | 11/1931 | Zang . | |
| 2,193,050 | 3/1940 | Wiest | 72/125 |
| 2,254,289 | 9/1941 | Jensen . | |
| 2,370,666 | 3/1945 | Johnson | 72/85 |
| 2,636,253 | 4/1953 | Rees | 72/359 |
| 3,709,016 | 1/1973 | Breidert et al. | 72/128 |
| 3,812,698 | 5/1974 | Stock | 72/71 |
| 3,924,432 | 12/1975 | Yarnold | 72/123 |

FOREIGN PATENT DOCUMENTS

| | | | |
|---|---|---|---|
| 3312156 | 1/1984 | Fed. Rep. of Germany . | |
| 3429465 | 3/1985 | Fed. Rep. of Germany . | |
| 0244088 | 3/1987 | German Democratic Rep. . | |
| 19113 | 2/1982 | Japan | 29/157 T |
| 168619 | 7/1987 | Japan | 72/84 |
| 292219 | 12/1987 | Japan | 72/71 |
| 623494 | 6/1981 | Switzerland . | |

*Primary Examiner*—Robert L. Spruill

*Attorney, Agent, or Firm*—Stevens, Davis, Miller & Mosher

[57] ABSTRACT

An upstanding collar is formed around a hole in a sheet metal blank by means of a converter tool which converts an edge region bordering the hole into the collar, while the blank is rotated relative to the converter tool. This method comprises (i) in a first stage, converting a portion of the blank into a first turned-up rim, (ii) after the first stage, converting a further portion of the blank into a second turned-up rim, (iii) in at least one further stage repeating step (ii) successively converting each time a further portion of the blank into another turned-up rim, until the whole of the edge region has been converted, wherein (a) in at least one of the stages the conversion takes place on free air, and (b) in all these stages the conversion takes place in the same direction relative to the blank. A converter tool increasing stepwise in diameter may be used.

18 Claims, 5 Drawing Sheets

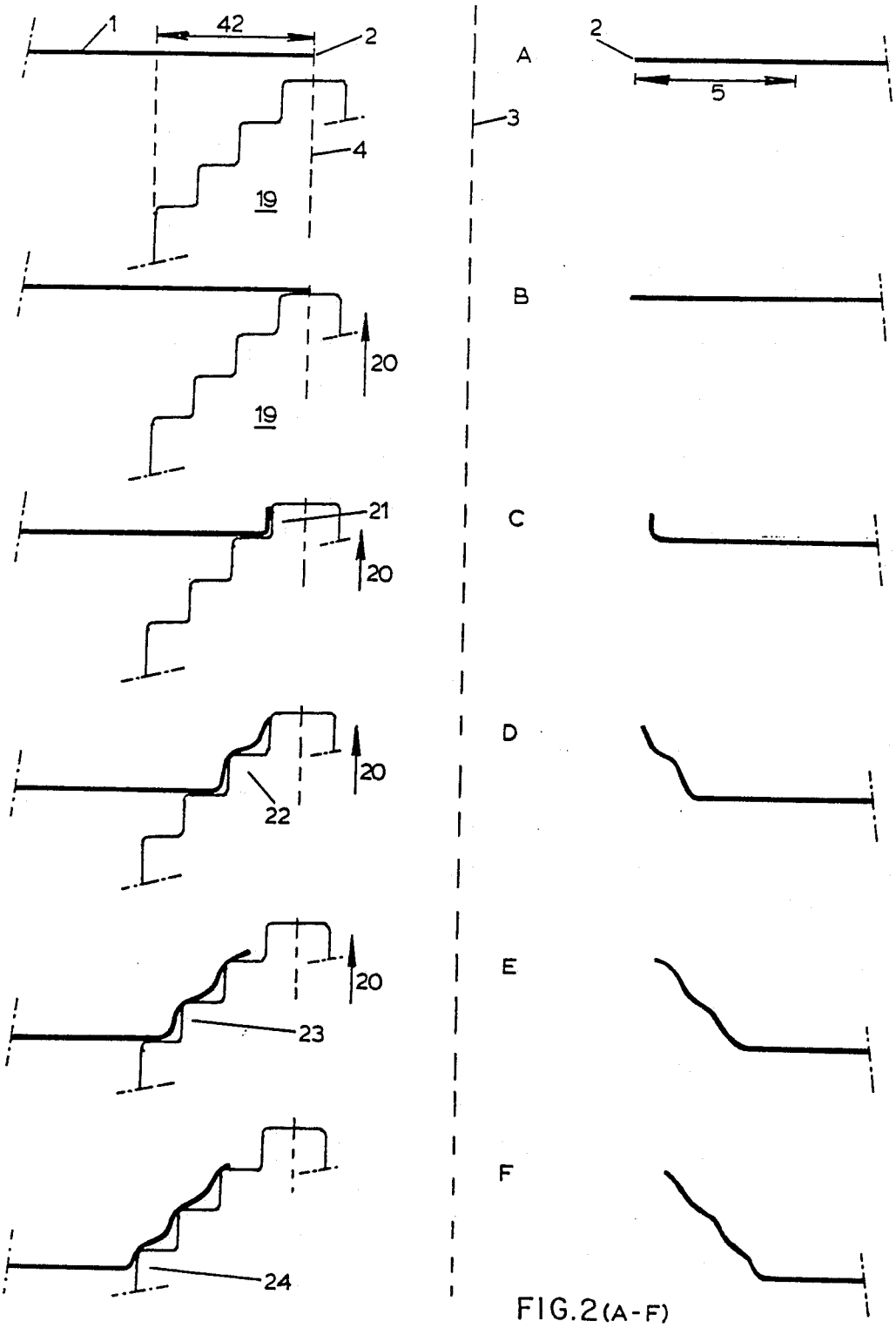
FIG.2(A-F)

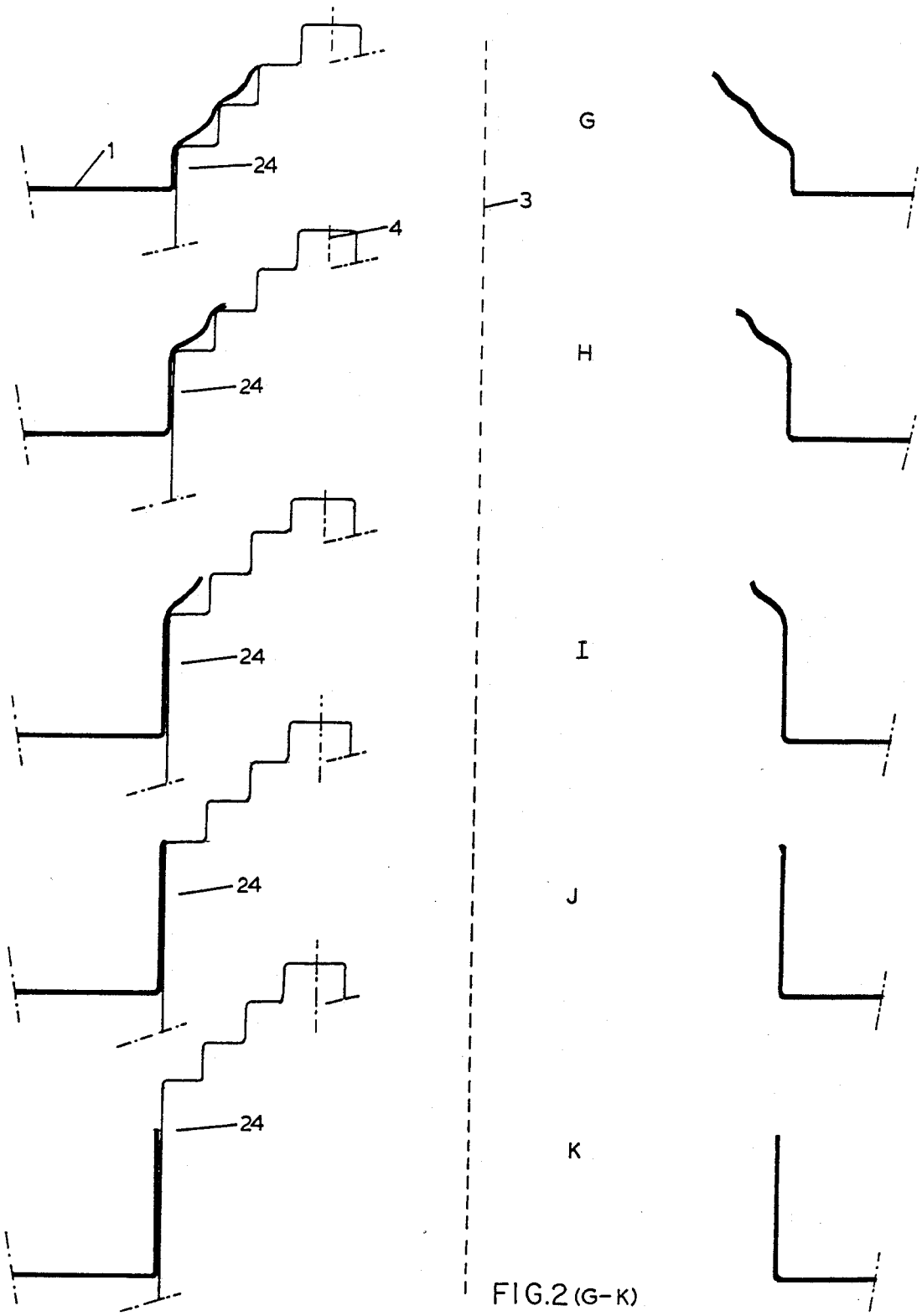
FIG.2 (G-K)

METHOD AND APPARATUS FOR FORMING A COLLAR AROUND A HOLE IN A SHEET METAL BLANK

BACKGROUND OF THE INVENTION

1. Field of the Invention

The invention relates to a method of forming an upstanding collar around a hole in a sheet metal blank, which is rotated relative to a converter tool, the converter tool converting an edge region of the blank bordering said hole into the collar. The invention also relates to conversion apparatus for performing such a method comprising a converter tool.

2. Description of the Prior Art

A method of the kind described above is known in practice in the manufacture of a packing for a coil of rolled steel. This packing has two packing covers, which cover respectively the flat bottom and flat top edges of the coil of rolled steel, and a sleeve which covers the cylindrical side wall of the coil of rolled steel. In order to seal the packing against dripping water and to prevent damage occurring to the rolled steel, the packing cover is provided with a turned-up edge at its outer circumference. A method and apparatus for manufacturing a lid with a turned-up edge at the outer circumference is known from NL-A-8302807.

The packing cover can be provided with a hole corresponding with the coiler hole in the coil of rolled steel. It is desirable to provide this cover hole also with a collar around its circumference which, like the turned-up edge of the outer circumference of the packing cover has the function of sealing the packing against dripping water and preventing damage to the coil of rolled steel.

In the known method, the collar around the hole in the cover is formed by clamping the cover, already provided with its hole, so that it can rotate, with a cylindrical hollow pressure plate on one side, the cylindrical inner wall of the pressure plate having the shape of the collar required, and then, by means of spinning, gradually pushing the edge portion bordering the hole against the inner side of the cylindrical wall of the hollow pressure plate. An inconvenience of this method is that for each dimension of cover hole another size of pressure plate is needed. Not only does this represent high investment in pressure plates, but also carrying out this method is costly in that the tool has to be changed for each new dimension.

Another disadvantage is that the spinning means are costly. It is necessary to have complicated spinning means in order to prevent the consequences of elastic spring-back in the turned-back edge of the collar. Additional measures for the spinning means are required to prevent angular distortion on the transition of the face of the blank towards the collar, which make the spinning means more costly still and place high demands on its use.

Other machines suffering similar disadvantages are described in the literature.

U.S. Pat. No. 2,370,666 shows a sheet working machine for forming a flange around a hole in a sheet by clamping the sheet between rollers adjacent the hole, rotating the sheet by means of the rollers and moving a dome-shaped shaping tool in one direction parallel to the axis of rotation so as to form the flange in one step against one of the rollers. U.S. Pat. No. 2,254,289 shows a similar machine, in which a part spherical axially reciprocating shaping tool forms the flange against clamping and rotating rollers. The sheet is gradually fed past the shaping tool.

Machines in which a flange is formed around a hole by radial movement of an appropriately shaped roller, while the sheet is rotated, are disclosed in U.S. Pat. Nos. 3,709,016 and 3,924,432.

The object of the invention is to overcome the disadvantages associated with this known method.

According to the invention in one aspect there is provided a method of forming an upstanding collar around a hole in a sheet metal blank by means of a converter tool which converts an edge region of the blank bordering said hole into said collar, while the blank is rotated relative to the converter tool which method comprises the steps of (i) in a first stage, converting a portion of said blank radially outwardly bordering said hole into a first turned-up rim, (ii) after said first stage, in a second stage, converting a further portion of said blank radially outwardly bordering said first turned-up rim into a second turned-up rim, (iii) in at least one further stage repeating step (ii) successively converting each time a further portion of the blank radially outwardly bordering the immediately previously turned-up rim into another turned-up rim, until the whole of said edge region has been converted, wherein the following conditions apply:

(a) in at least one of said stages the conversion takes place on free air as herein defined, and (b) in all said stages the conversion takes place in the same direction relative to the blank.

In the method according to the invention, a first turned-up rim is formed from a first part of the edge portion around the hole, which rim reinforces the edge portion around the hole. Then, using the reinforcement obtained, it is possible to convert a second part of the edge portion into a second turned-up rim with a larger diameter than the first turned-up rim. The step-wise conversion of the edge portion is continued until the entire edge portion has been converted and the converted edge portion forms a collar on the blank at the position of the coil hole.

This conversion of the edge portion in stages is carried out at least partly preferably entirely on free air. The term "on free air" comes from the technique of spinning. Article 2.8 on page 17 of the brochure "Forceren en Vloeidraaien van Staal", No. 301, Sixth Edition, published by "Stichting Staalcentrum Nederland", states: "One of these operations is 'taking in on free air'. This is the local reduction in centreline without the presence there of a pattern form". By analogy in this application "converting on free air" is taken to mean the conversion of material without the presence there of a pressure plate or another kind of pattern form against which the material to be formed is pressed.

Preferably a part of the edge portion is converted into a turned-up rim at 90° to the blank. This results in a very high stiffness of the edge portion, making the forming of a subsequent turned-up rim easier to achieve. A larger part of the edge portion to be formed can be converted at each stage.

Preferably, after a plurality of turned-up rims has been formed, the last turned-up rim already formed is converted on free air into a larger diameter turned-up rim. When this is done on all the turned-up rims formed, a collar is obtained in which the originally formed edges are eliminated and pass into each other forming a collar of the required shape. Using this feature in combination with the effect described earlier produces a collar of a circular cylindrical shape perpendicular to the plane of the blank.

As a result of the elasticity of the material of the blank, the collar springs back elastically. The spring-back is particularly noticeable at the outer end of the collar remote from the plane of the blank. Preferably at least the end part, remote from the plane of the blank, of the first turned-up rim is pushed into the size required. In this way, the consequence of the elastic spring-back is reduced to a desirable degree.

In an especially simple embodiment of the method a portion of the blank bordering on the turned-up rim last formed is pushed out of the plane of the blank within the elastic region of that portion of the blank, and the inwardly directed force generated by this on the end part remote from the blank of the first turned-up rim is opposed at least partly by the converter tool.

In practice, it appears that good results are achieved, especially with steel blanks, if the edge region is converted in stages of about 1 cm radial length.

When the method is applied in the manufacture of steel covers, good results have been achieved when the increase in height of a turned-up rim during conversion lies between 0.5 and 4 mm per rotation of the steel blank and in particular when the increase in height of a turned-up rim during conversion lies between 1 and 2 mm per rotation of the steel blank.

In another aspect, the invention provides conversion apparatus for forming an upstanding collar around a hole in a sheet metal blank by converting an edge region of the blank adjacent said hole into said collar, comprising (a) a converter tool (b) clamping means for said blank, (c) means for rotating said clamping means relative to said converter tool about an axis, and (d) means for moving said converter tool, parallel to said axis in order to perform the conversion, (e) said converter tool comprising a mandrel which engages the metal blank during the conversion and which has in the direction of said axis a foremost end and a rearmost end, and the blank engaging surface of the mandrel being a surface of rotation which from said foremost end to said rearmost end increases in diameter non-linearly and at least partly in a plurality of steps.

With such an apparatus, especially with all increases being stepwise, a first part of the edge portion bordering on the hole may be converted while initially a second part of the edge portion bordering directly on it remains untouched. By moving the mandrel further in the direction of the blank parallel to the axis of rotation of the clamping device, the second part of the edge portion is converted.

If so desired, the mandrel can be built up from a number of separately manufactured elements, for example by taking one disc per stepwise increase of the desired diameter and stacking all the discs on top of one another. In this, the discs may be fixed relative to one another or they may be rotatable relate to one another.

In the embodiment in which individual discs are fixed relative to each other, or in which the mandrel is essentially a single solid body, the rotational speed at different positions from the foremost extremity to the rearmost extremity depends on the position. In order to reduce the speed difference between different positions on the mandrel and the parts of the edge portion already converted, preferably the magnitude of the stepwise diameter increase decreases from the foremost end towards the rearmost end. This also achieves the advantage that, the more the mandrel forms more turned-up edges, and the more it comes into contact with more material of the blank, the less quickly will the distorting forces increase with each successive conversion stage.

Preferably the increase in diameter between two successive stages is essentially nil, whereby the portion where the material of the blank is in contact with the mandrel is diminished and relative speed differences and friction have less effect.

In order to prevent heavy local distortion of the blank, the salient angles at the outwardly projecting corners of the steps of the mandrel are rounded off and in particular are rounded off at a radius of between 5 to 10 times the thickness of the blank. Practical trials have shown that with this embodiment there is a good balance between on the one hand the metallurgical reinforcing of the material of the blank as a consequence of the distortion, and on the other hand the conditions of tension occurring in the material of the blank which induce distortion.

Preferably also in a median plane two connecting lines joining the outwardly projecting corners of the steps of the rotation surface closest to the foremost end intersect each other transversely. Using such a mandrel in accordance with this embodiment, and with only a small axial movement of the mandrel, a large part of the edge portion may be converted without any large forces acting on the edge portion.

Preferably the largest diameter of the mandrel is larger than or equal to the height of the collar to be formed.

During conversion any stretching in the material occurs mainly in the circumferential direction of a turned-up rim; only a little residual distortion occurs in the height direction of a turned-up rim. That means that the radial length of the turned-up rim to be converted is approximately equal to the height of the collar formed. It is desirable that at the start of conversion, the mandrel axis should not cut the blank, because otherwise the edge of the hole displays an unstable behaviour during conversion of the first turned-up rim. Therefore, the maximum diameter of the mandrel should be preferably larger than or equal to the radial length of the whole converted edge portion. This also means that the maximum diameter of the mandrel should be preferably larger than or equal to the height of the collar to be formed.

Preferably the increase of the diameter at a base part of the mandrel adjacent the rearmost end is nil and the height of this base part is at least as large as the height of the collar to be formed. By moving the mandrel over the entire base part past the face of the blank in parallel with the axis of rotation of the clamping device, an essentially cylindrical collar is formed in the blank.

Furthermore this base part assists in setting in place the part of the collar which is already formed further from the plane of the blank, whereby that part springs back less elastically and a better shaped collar is formed. For certain uses of blanks with extended collars, it is desirable to have a collar with an even more diminished elastic spring-back, which can be achieved with the apparatus which is the mandrel is provided at its rearmost end with a pressing element for pressing up, out of the plane of the blank, a part of the blank that borders on the last formed turned-up rim. By pressing this pressing element against the transition from the flat part of the blank and the edge portion which was formed last, the transition is pressed locally and elastically out of the plane of the blank. Through this the part of the collar formed first, i.e. the upper end, undergoes an inwards force which presses a part of the upper end of the collar against the cylindrical base part of the mandrel. This distorts the upper side plastically, so that it springs elastically less far back after the mandrel has been withdrawn.

Preferably the mandrel is free to rotate, so that it is brought into rotation on its axis by the friction of the material of the blank and a separate drive for the mandrel is not needed.

BRIEF INTRODUCTION OF THE DRAWINGS

FIG. 1 illustrates the invention schematically with reference to a first embodiment, FIG. 2 A-L shows another embodiment of the method also schematically, FIG. 3 shows an embodiment of the method in which the edge of the collar is extended, FIG. 4 shows an embodiment of a mandrel for apparatus of the invention, and FIG. 5 shows a converter apparatus in which the invention is embodied.

DESCRIPTION OF THE PREFERRED EMBODIMENTS

Figure 1:
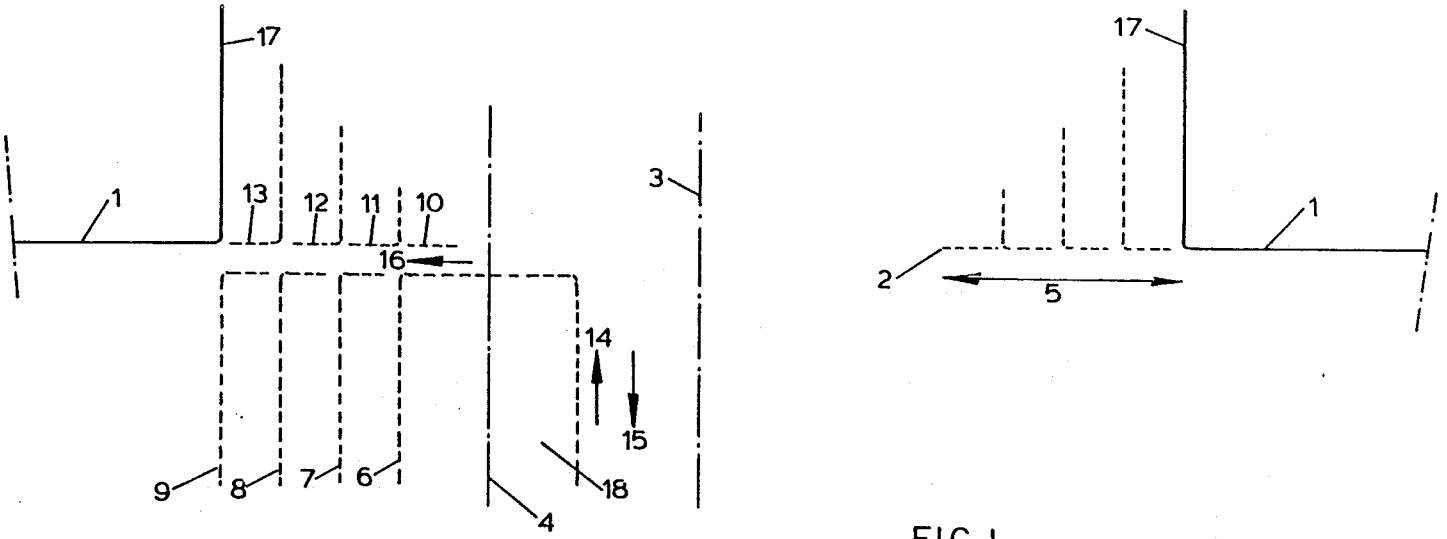

In FIG. 1 a disc shaped blank 1 is with a central hole, bordered by an inner edge 2. The blank is rotated perpendicularly to the plane of the drawing around the axis 3. A converter device in the form of a mandrel 18 rotates freely on its longitudinal axis 4 and is not driven. The longitudinal axis 4 of the mandrel does not coincide with the axis 3. At the start, the mandrel is in the position marked 6 partly opposed to a part 5 of an edge portion around the hole. The edge portion 5 is to be converted into a collar. By moving the mandrel in the direction of arrow 14, a part 10 of the edge portion bordering on the hole is converted into a first turned-up rim. After this edge has been formed, the mandrel is moved backwards in the direction of arrow 15 and then advanced one step in the direction of arrow 16 into the position marked 7. Next the mandrel is moved upwards once again in the direction of arrow 14 converting the part of the edge portion marked 11. By moving the mandrel far enough in the direction of arrow 14, the first turned-up rim in the extension of the second turned-up rim is converted on free air.

In the same manner as described above, parts 12 and 13 of the edge portion 5 are also converted from mandrel 18 positions marked 8 and 9 respectively. By converting the entire edge portion 5 in the manner described, the desired collar 17 is produced.

Figure 2L:
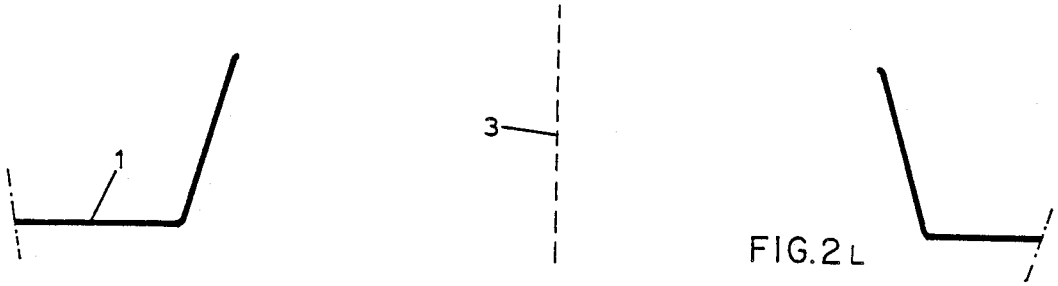

FIG. 2 shows another way of converting an edge portion around a hole to a collar. The corresponding reference numbers of FIG. 1 indicate corresponding parts in FIG. 2. FIG. 2A shows the blank 1 and the freely rotating mandrel 19, in their stationary positions relative to one another. In the situation shown, the edge 2 of the hole is at the longitudinal axis 4 of the mandrel. This is the most extreme position for practical use; in a situation in which the edge 2 extends beyond the longitudinal axis, the longitudinal axis cuts the blank, and so the behaviour of edge 2 is difficult to control during conversion. Moreover, the closer the longitudinal axis 4 comes to the edge 2 the greater are the forces acting for conversion on the edge portion, at the time when initially the edge portion is not yet reinforced.

In FIG. 2B the mandrel 19 is shown moved in the direction of arrow 20 until it just touches the blank which is now in rotation on its axis 3. By moving the mandrel further in the direction of arrow 20, the situation shown in FIG. 2C is reached. Here the first of the turned-up rims is formed by the disc-shaped element 21 of the mandrel. The first turned-up rim gives a reinforcement to the portion of the blank surrounding the hole, which now makes it simpler to form a second turned-up rim, and means that more converting force may be exercised than would be possible without the presence of the first turned-up rim. By moving the mandrel 19 further in the direction of arrow 20, the upper surface of disc shaped element 22 pushes upwards that part of the edge portion bordering on the first formed turned-up rim, and by moving still further, element 22 forms the second of the turned-up rims as may be seen in FIG. 2D. In this way the previously formed turned-up rim is pulled along element 21 and is thereby further stretched over at least a part of its height.

In the next stage, as shown in FIG. 2E, element 23 of the mandrel forms another turned-up rim. The first of the turned-up rims formed has now left element 21 and is already partially pulled across element 22 and thereby is stretched out still further.

FIG. 2F shows the last turned-up rim formed by the mandrel being moved further and the last part of the edge portion being converted into a turned-up rim by element 24. By the movement of the mandrel, the earlier formed turned-up rims are drawn further across the previous elements 22 and 23 and thereby continue to be formed and stretched.

Figure 3:
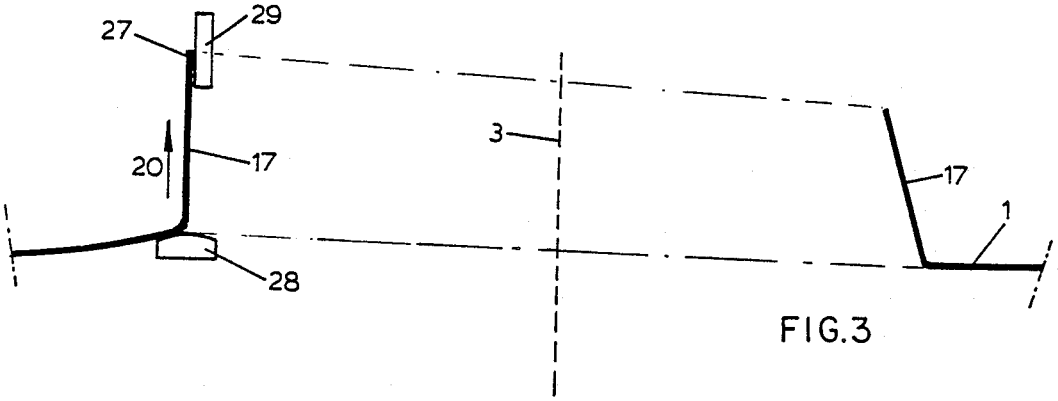

FIGS. 2G, 2H, 2I and 2J show how the turned-up rims formed are drawn successively across elements 22 and 23, and finally brought to a final dimension by element 24. FIG. 2L shows in section a blank with its collar as is obtained after removal from the apparatus described. The figure shows, though not to scale, that, as a result of elastic spring-back the collar does not have a cylindrical shape. When using the blank, or the cover made from it in places where it is desirable for the collar to have a better approximation of a cylindrical shape, the collar may be converted yet further by making use of a further embodiment of the invention, as shown in FIG. 3. Once again 1 indicates the blank, 17 the collar and 3 the rotation axis of the blank. By means of tool 28 which is moved in the direction of arrow 20, a part of the blank adjoining the collar 17 is pushed upwards over part of the circumference in the direction of arrow 20 within the elastic region of the blank. The collar 17 experiences a force on its upper edge 27 directed towards the axis 3 of the collar. A movement of the upper edge 27 towards the axis 3 is blocked by a tool 29. The force with which the upper edge 27 is pressed against the tool 29 stretches the collar further into the plastic region of the material of the collar. This gives the collar a shape which more approximates a cylinder than the shape of the collar before the operation here described.

Figure 4:
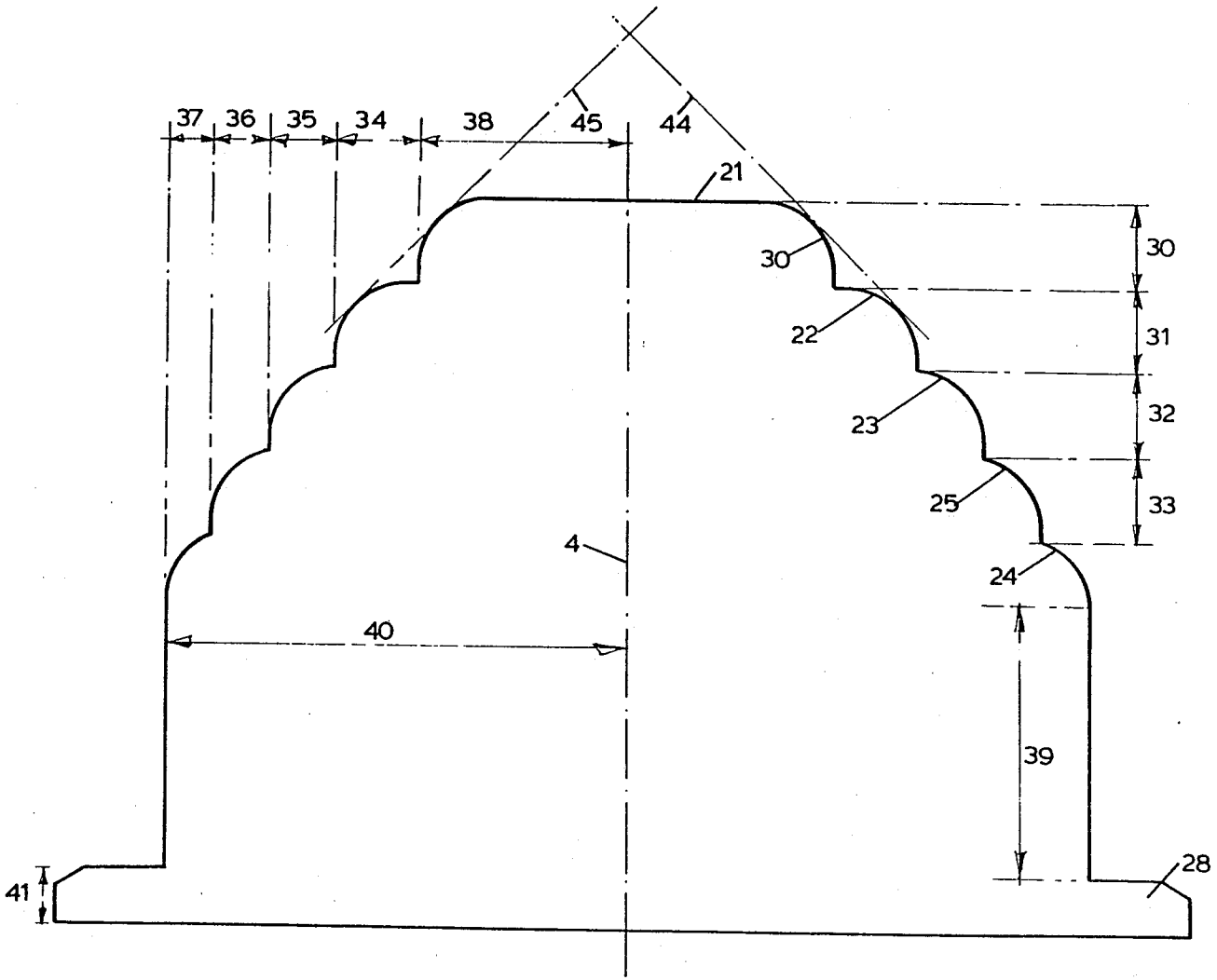

FIG. 4 shows a mandrel for carrying out the method described above. Parts of the mandrel with corresponding functions in previous figures have been given the same reference numbers as marked in those previous figures. Only the exterior contour of the mandrel has been drawn, any design features needed to allow the mandrel to rotate freely or to be driven being known and being apparent to an expert.

The mandrel has elements 21, 22, 23, 25 and 24 of stepwise increasing diameter for the stepwise conversion of an edge portion around a hole in a blank, the height of the elements 21, 22, 23 and 25 indicated respectively by 30, 31, 32 and 33 being the same for all elements in the version as drawn. The elements are rounded off at their salient angles projecting outwardly with radii 30 which are also shown here as equal for all elements, including element 24. In practice a useful value for the rounding radius, applicable for steel blanks among others, is 5 to 10 times the thickness of the blank. The cylindrical height of the lowest element 24 is indicated by 39 and is at least equivalent to the height of the collar to be formed, in order that the collar may be formed in one single operation.

The radius of the uppermost element 21 is indicated at 38. References 34,35,36 and 37 indicate the amount by which the radius of each subsequent element increases relative to the previous one. This amount decreases in proportion to the increase in diameter, in order that, in later operating phases in which several elements take part in the converting process at the same time, the total distortion force acting on the mandrel is reduced.

It has already been observed in the description of FIG. 2A that the longitudinal axis 4 of the mandrel preferably should not intersect the blank. Furthermore the collar height is determined by the distance from the edge 2 of the hole of a blank to the cylindrical part of the last element 24, as is shown in FIG. 2A by 42. The effect of the above two advantages combined is that preferably the radius of the cylindrical part 40 of the mandrel should be greater than or equal to the height of the collar to be formed.

The height of the collar which can be obtained without the collar cracking, depends on the capacity for distortion of the material of the blank. The edge 2 of the hole in the blank is stretched to the diameter of the collar. For a material like steel, the plastic stretching preferably should be limited to less than 30%. This value determines the attainable height of the collar for a given hole diameter.

The two connecting lines 44 and 45 join each of the corners of the two uppermost elements 21 and 22 and lie in a meridian plane of the mandrel. The two lines intersect each other transversely.

The underside of the mandrel is provided with an edge 28 for pressing up elastically the part of the blank bordering on the collar. In the manner described above, this can extend the collar in order to obtain a better approximation of a circular cylindrical shape. Continued extension can then take place following on directly from the shaping of the collar and in the same operation. For steel blanks, the height 41 of the pressing edge 28 is of the order of 1 to 2 mm.

Figure 5:
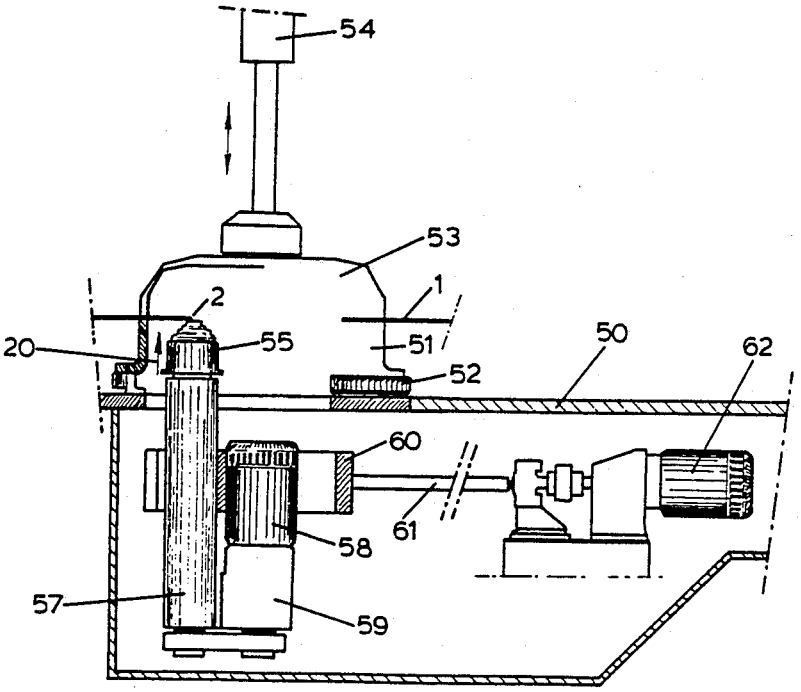

FIG. 5 shows diagrammatically a converter apparatus which embodies the invention. Such an apparatus may be used on its own, or may form part of a larger apparatus such as a spinning machine as described in NL-A-8302807.

In FIG. 5 a frame 50 is shown. A lower ring 51 supported in a bearing is set on the frame and it is provided with a sprocket 52. A driven pinion, not shown in the drawing, can be linked to the sprocket for rotating the lower ring 51. Above the lower ring 51 and coaxially with it, a freely rotating pressure plate 53 is suspended. Using a pneumatic cylinder-piston combination 54, partly shown, the pressure plate can be kept a certain distance from the lower ring.

The blank 1 having a hole to be converted is placed in the gap between the lower ring 51 and pressure plate 53, and centered using a centering means not shown in the drawing. Suitable means for centering are known from, for example, NL-A-80006521. After the blank has been centered, the pressure plate 53 is moved downwards by means of the cylinder-piston combination 54, so that the blank is clamped in the apparatus. Furthermore, the apparatus is provided with a freely rotating mandrel 55 e.g. as shown in FIG. 4. The mandrel 55 is fitted on the nut of a screw-spindle 57. The screw-spindle 57 is drivably coupled to a motor 58 and a gear mechanism 59.

The assembly 55,57,58,59 is fitted on the nut 60 of a second screw-spindle 61 which is drivably coupled to the motor 62. By means of the motor 62, the screwspindle 61 and the nut 60, the mandrel 55 is positioned in the desired radial position relative to edge 2 of the blank. Then the radial position of the mandrel is fixed relative to the frame 50. When the blank 1 is rotating at the desired speed, the mandrel is moved in an axial direction by means of components 58,59,57 in the direction of arrow 20. The axial movement of the mandrel 55 is synchronised with the rotation speed of the blank 1. For steel blanks the mandrel is moved axially approximately 1 to 2 mm per rotation of the blank. After the collar has been formed and extended as required, the mandrel 55 is moved downwards again and after the pressure plate 53 is lifted up, the blank can be taken out of the machine.

When the apparatus in accordance with the invention forms part of a spinning machine for making lids, it is possible at the same time to spin an edge on the outer circumference and convert a collar around the hole in the blank. Then the rotation speed of the blank is determined initially by the spinning action. If this is rounded off, then for further collar forming, the rotation speed may be increased.

By way of illustration the following are a few details of a converter apparatus for making a steel lid for a packing for a coil of rolled steel: outer circumference of the blank between 800 and 2100 mm; during collar forming the axial extension of the mandrel is 1.5 mm/rotation of the blank, the hole diameter of the blank lies between 400 and 650 mm, the height of the collar formed lies between 45 and 65 mm, the radius of the uppermost element of the mandrel is as a minimum the rounding radius which in practice is at 7 mm; a practical value is 25 mm. The radius of the cylindrical part of the lowest element is 70 mm, the difference in radius between the uppermost element and the one below it is 15 mm; the reduction of this difference in radius is about 2.5 mm for each subsequent element.

What is claimed is:

1. Method of forming an upstanding collar around a hole in a sheet metal blank by means of a freely rotatable converter tool on an axis different from an axis about which said blank rotates which converter tool converts an edge region of the blank bordering said hole into said collar, while the blank is rotated relative to the converter tool which method comprises the steps of (i) rotating the blank about a central axis, (ii) moving said converter tool in a first stage in an axial direction into contact with a portion of said blank radially outwardly bordering said hole to convert said portion into a first turned-up rim, (iii) moving said converter tool after said first stage, in a second stage, in an axial direction into contact with a further portion of said blank radially outwardly bordering said first turned-up rim to convert said further portion into a second turned-up rim, (iv) repeating step (iii) in at least one further stage to convert successively a portion of said blank each time a further portion of the blank radially outwardly bordering the immediately previously turned-up rim is turned into another turned-up rim, until the whole of said edge region has been converted, wherein the following conditions apply:

(a) in at least one of said stages the conversion takes place on free air as herein defined, and (b) in all said stages the conversion takes place in the same direction relative to the blank.

2. Method according to claim 1 wherein said blank is initially planar and said hole is circular.

3. Method according to claim 1 wherein at least the collar finally formed stands up at 90° to the blank.

4. Method according to claim 1 wherein, after a plurality of said turned-up rims has been formed, the turned-up rim last formed is converted on free air into a larger diameter turned-up rim.

5. Method according to claim 1 including pushing in at least one stage of the stages (iii) and (iv), a portion of the blank bordering the turned-up rim last formed, out of the plane of the blank within the elastic region of that portion of the blank and generating an inward force on an end part remote from the blank of the first turned-up rim opposed at least partly by the converter tool.

6. Method according to claim 1 wherein, in each of said stages the radial length of the converted portion is about 1 cm.

7. Method according to claim 1 wherein the blank is of steel and the increase in height of a said turned-up rim during conversion is between 0.5 and 4 mm per rotation of the blank.

8. Method according to claim 7 wherein the increase in height of a said turned-up rim during conversion is between 1 and 2 mm per rotation of the blank.

9. Conversion apparatus for forming an upstanding collar around a hole in a sheet metal blank by converting an edge region of the blank adjacent said hole into said collar, comprising (a) a converter tool freely rotatable about a first axis, (b) clamping means for said blank, (c) means for rotating said clamping means relative to said converter tool about a second axis, and (d) means for moving said converter tool, parallel to said second axis in order to perform the conversion, (e) said converter tool comprising a mandrel which engages the metal blank during the conversion and which has in the direction of said first axis a foremost end and a rearmost end, and a blank engaging surface, said blank engaging surface of the mandrel being a surface of rotation which from said foremost end to said rearmost end increases in diameter non-linearly and at least partly in a plurality of steps.

10. Conversion apparatus according to claim 9 wherein, in said plurality of steps, the magnitude of diameter increase at each step decreases from said foremost end towards the rearmost end.

11. Conversion apparatus according to claim 9 wherein the increase in diameter of said blank-engaging surface of the mandrel is, at one said step, essentially nil.

12. Conversion apparatus according to claim 9 wherein said steps of said blank engaging surface have outwardly projecting corners which are rounded.

13. Conversion apparatus according to claim 12 wherein said outwardly projecting corners of said steps are rounded at a radius of between 5 and 10 times the thickness of the blank.

14. Conversion apparatus according to claim 9 wherein said steps of said blank engaging surface have outwardly projecting corners and in an axial meridian plane of the mandrel two connecting lines joining said outwardly projecting corners of the blank engaging surface closest to the foremost end intersect each other transversely at said axial meridian plane.

15. Conversion apparatus according to claim 9 wherein the largest diameter of the blank engaging surface of the mandrel is at least as large as the height of the collar to be formed.

16. Conversion apparatus according to claim 9 wherein at a base region of the blank engaging surface of the mandrel adjacent said rearmost end thereof, there is no increase of diameter, said base region having a length in said axial direction which is at least as large as the height of the collar to be formed.

17. Conversion apparatus according to claim 9 wherein said mandrel is provided adjacent its rearmost end with a pressing element for urging out of the plane of the blank a part of the blank adjacent the collar formed.

18. Conversion apparatus according to claim 9 wherein said means for relatively rotating rotates the clamping means for the blank, and said mandrel is freely rotatable about its axis.

* * * * *